United States Patent [19]

Szakacs et al.

[11] 4,090,550

[45] May 23, 1978

[54] LEAD ACID BATTERY GRID CASTING SYSTEM INSTALLATION AND TECHNIQUE

[76] Inventors: Bela Szakacs, 2215 Widgon Ct., Winston-Salem, N.C. 27106; Frank Scrattish, 1082 Edgewood Dr., Winston-Salem, N.C. 27103

[21] Appl. No.: 770,600

[22] Filed: Feb. 22, 1977

[51] Int. Cl.[2] ..... B22D 31/00; B22D 25/04; B22D 35/00; B22D 47/00

[52] U.S. Cl. ..... 164/70; 164/337; 164/70; 164/DIG. 1; 164/322; 29/527.6

[58] Field of Search ..... 164/5, 50, 70, 76, 129, 164/250, 266, 322, 337; 29/527.6

[56] References Cited

U.S. PATENT DOCUMENTS

| | | | |
|---|---|---|---|
| 2,763,040 | 9/1956 | Korb | 164/250 X |
| 3,192,293 | 6/1965 | Van Riper | 425/217 X |
| 3,371,186 | 2/1968 | Trabilcy | 164/337 X |
| 3,815,659 | 6/1974 | Pavlo et al. | 164/337 X |
| 3,900,064 | 8/1975 | Chandley et al. | 164/129 X |

*Primary Examiner*—Francis S. Husar
*Assistant Examiner*—Kuang Y. Lin

[57] ABSTRACT

A lead melting furnace or pot, large enough to provide molten metal for 6–18 grid casting machines, is isolated from the casting machines in a separate, remote, room or chamber. The automatically fed, electrically heated, covered and insulated furnace is positioned at a level above the inlet to the casting machines, so that the molten metal is gravity fed from one or more bottom discharge outlets whereby conventional pumps are eliminated and agitation of the molten metal in the furnace minimized. An impedance heated feed line system connects the furnace and casting machines and elevates the molten metal from the relatively low 700°–800° F. temperatures achieved in the furnace to the required 850°–1100° F. casting temperature. A specially designed exhaust hood covers each group (preferably 3) of casting machines to exhaust contaminated gases and simultaneously provide make-up air to minimize the effect on the casting room atmosphere. A scrap conveyor continuously collects excess lead trimmed from the finished grids and returns the reusable metal immediately to the furnace.

10 Claims, 7 Drawing Figures

LEAD ACID BATTERY GRID CASTING SYSTEM INSTALLATION AND TECHNIQUE

BACKGROUND OF THE INVENTION

The manufacture of lead acid batteries requires the fabrication of approximately 78 perforated lead plates or grids for each battery. One well-known method for fabricating such perforated lead grids is by gravity casting. In order to achieve proper surface characteristics, it has been known to include small amounts of antimony, calcium or other materials. The casting procedure generally involves the melting of lead pigs or bars, along with the alloying materials in a furnace or pot, and the transmission of the molten metal to a casting machine, where amounts of the molten metal are introduced between the mold portions. With such conventional techniques, several problems have arisen and remain unsolved, which problems including drossing, environmental problems in the workroom, and excessive heating costs and energy losses.

Considering each of the general problems set forth above, environmental problems include those which lead to discomfort for employees resulting from the excessive heat given off by the furnaces and the open gas-heated feed lines. The excessive amount of heat generated make conditioning of the air substantially not feasible. It would take too much make-up air in such a situation to provide any semblance of comfort within the casting room environment of prior techniques. Therefore, traditionally the casting areas for battery grids have become environmental nightmares. Operating personnel have had to endure excessive heat stress in such situations.

Further, and perhaps more importantly, excessive amounts of lead dust are normally given off both at the furnace and at the casting machines. OSHA has, at the time of this application, set limits of 0.200 milligrams of lead dust per cubic meter of air as a safe maximum allowable limit. However, it is expected that the upper limit will soon be o changed to 0.150 milligrams per cubic meter. Present methods and techniques barely meet these requirements, and if the reduction of the maximum allowable amount is made, many such systems may not be able to meet the OSHA requirements.

The aforementioned drossing is the formation of a lead oxide scum on the surface of molten lead, caused by contact of the molten lead with oxygen. Such dross cannot be cast, as the resulting product will be inferior. Therefore, at frequent periods, this dross must be removed and shipped back to the smelter for reprocessing. It cannot be remelted at the grid casting operation.

In known systems, the lead/oxygen contact could hardly be greater. The lead is subjected to oxygen because of the use of open top furnaces. Further, the more furnaces used, the greater the surface area of lead exposed to oxygen. Also, the agitation created by the pumping of the molten lead from the furnaces through the feed lines to the casting machines even further increases the amount of dross realized. Another problem is that the higher the lead is heated, the greater the likelihood of drossing. The frequent dropping of new pigs by workmen into the open top furnace further agitates the molten material, even causing some of it to splash, which not only increases the drossing, but also is quite hazardous to workmen.

The effects of the drossing are readily apparent. As drossing increases, waste increases and the production output of grids from a given amount of lead pigs decreases. Further, the frequent stoppages necessary to frequently skim off the dross from the furnaces and other places slows down the productivity of the operation. The drossing will eventually gum up feed lines to the extent that conventional feed lines do not last longer than six months. Either the gas burns up the feed line, electrically heated strip heaters will burn out, or the aforementioned drossing is pumped into the feed lines until they are completely plugged.

Another deleterious effect from the drossing occurs in the quality of the product. Excessive, even though allowable, amounts of dross in the finished grids reduce the life of batteries. Further, in addition of such alloy materials as calcium causes dross to occur considerably faster than conventional antimonal alloys so that processing lead grids with low antimony or calcium alloys is practically impossible in conventional techniques.

Very few attempts have been made to alleviate this situation and the aforementioned problems. One of them is described in U.S. Pat. No. 3,815,659 to Pavlo et al which shows the introduction of an oxygen free superheater between the conventional furnace and the ladle for boosting up the molten material to the desired casting temperature, after it is preheated to a melted, but less than adequate casting temperature in the furnace. While this may help some, the furnace is still open and the other problems still exist.

SUMMARY OF THE PRESENT INVENTION

The present invention, on the other hand is directed to a completely new approach and solution to the problems surrounding the casting of battery grids which, first of all, includes a new layout concept. In the system according to the present invention, one larger furnace serves 6–15 or more casting machines. The furnace is located remotely and isolated from the casting machines in a separate room so that the heat and lead dust generated thereby is not a factor as far as the control of the working conditions in the casting room itself is concerned.

The furnace itself is elevated above the casting room floor and includes a bottom discharge means which is at an elevation higher than the corresponding receiving portion of the casting machines. Therefore, the molten material is fed by gravity from the furnace through the feed lines to the casting machines with the conventional pumping and its attendant problems eliminated. Since the dross tends to migrate to the surface the resulting molten lead delivered to the feed line will be pure. The furnace is covered, and for that matter is almost totally enclosed and substantially oxygen free to reduce the drossing tendency of the molten lead. Further, the furnace is insulated and operated electrically to a reduced melting temperature of 700°–800° F. There are two conveyors delivering input to the furnace, one for raw pigs and the other for returning trim material. Both of the conveyorized feed devices eliminate the necessity for operators to feed material into the furnace by hand.

The molten metal delivery lines are a new type of feed line for this type of operation. Such feed lines in and of themselves have been used before in other industries; however, not for the delivery of molten material from melt furnaces to casting machines. As such, the feed lines are impedance heated and totally enclosed, whereby the molten lead is increased in temperature from the 700°–800° F. to a casting temperature of 850°–1100° F.

The casting machines are substantially the same as conventional casting machines, except for the arrangement in which the machines are grouped and positioned beneath one or more specially designed exhaust hoods. The exhaust hoods have a central outlet portion and a surrounding inlet portion. Contaminated exhaust gases from the casting machines are removed through the central passageway, while make-up air is delivered through an outer passageway, so that the environmental conditions within the room are not materially changed. A trim or scrap collection system is provided in the form of a conveying apparatus which passes under each machine and delivers the trim removed from each grid to the trim input conveyor leading back into the furnace described hereinabove.

With the foregoing structural changes implemented, considerable advantages have been achieved. Environmental problems have been brought under control. The elimination of so much heat and contaminated gases and fumes in the casting room has now made conditioning of the air and atmosphere therein possible where it was not before. Lead fumes and dust concentrations are consistently measured at no more than 0.02 milligrams per cubic meter of air, which is, for intents and purposes, negligible.

Drossing of the alloy has now been minimized, both from the standpoint of amount of dross appearing in the final product (50% less), as well as the amount of dross generated and skimmed off to be sent back to the smelter (85% reduction). As a result of these and other advantages, production has been increased by 50%, the feed lines operate 70% more efficiently, the furnace operates 80% more efficiently, and the end product is more uniform and of higher quality than ever before achieved. Additionally, feed line maintenance has been completely eliminated.

It is therefore an object of the present invention to provide an improved technique and layout for the casting of battery grids.

It is another object of the present invention to improve the casting of battery grids by isolating the lead melting furnace from the casting machines.

Another object of the present invention is to achieve the melting and delivery of molten lead to grid casting machines in an atmosphere that is as oxygen free as feasible.

It is further an object of the present invention to provide improved battery grid casting system of the type described in which the lead melting furnace is mounted at an elevation higher than the casting machines, so that the molten metal may be gravity fed, eliminating the pumping and agitation of the molten metal in the furnace which leads to increased drossing.

Yet another object of the present invention is to provide a battery grid casting system in which the alloy is melted in the furnace. Then the alloy is raised to casting temperature during delivery in heated feed lines.

It is still another object of the present invention to provide an installation for casting battery grids in which the environment surrounding the casting machines can be controlled.

Other objects of the present invention will become apparent from reading the following detailed description of a preferred grid casting installation in view of the accompanying drawings, in which.

DETAILED DESCRIPTION OF A PREFERRED EMBODIMENT

Figure 1:
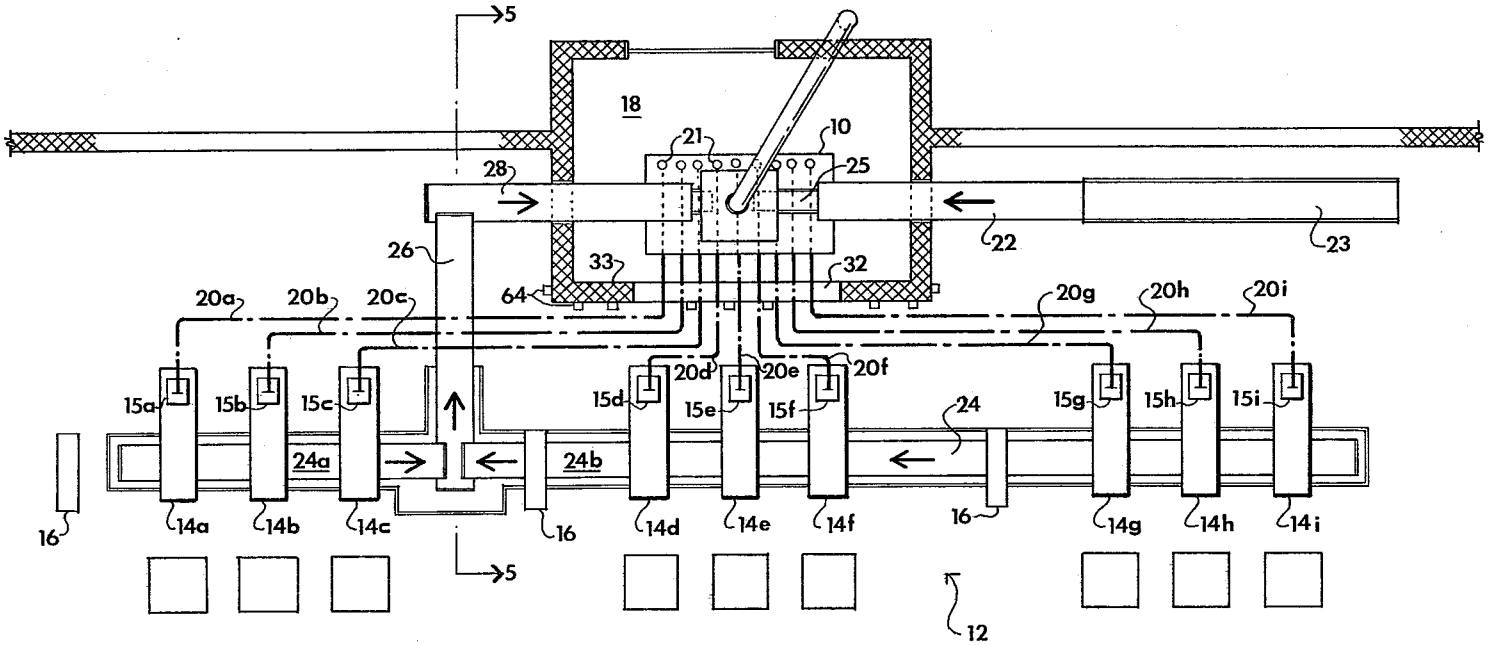
FIG. 1 is a schematic plan representation of the battery grid casting installation according to the present invention.

Turning now to a discussion of the installation according to the present invention, there is illustrated in FIG. 1 a plan view of the installation which includes a single furnace 10 which serves a plurality of casting machines 14*a*-14*i*. The casting machines 14 are preferably grouped into operating stations containing three machines each and each station is provided with a control panel 16 at which point the operator controls the functioning of the three machines, feeds, mold temperatures and the like. Further, the casting machines 14 are preferably of the type in which the work pieces are trimmed within the casting machine, however, could be otherwise so that the trim is accomplished in a separate operation.

The furnace 10 is located at a remote position isolated from the casting area 12 by walls which enclose the furnace and form a furnace room 18 for reasons to be hereinafter described. A plurality of heated feed lines 20*a*–20*i* connect the molten metal outlets 21 of the furnace in the bottom thereof with the receiving inlet of each casting machine 14. Preferably, a separate feed line 20*a*–20*i* connects each casting machine with the furnace. However, it is possible that one or more larger trunk lines could be attached to the furnace with a feeder arm leading therefrom to each machine.

Figure 2:
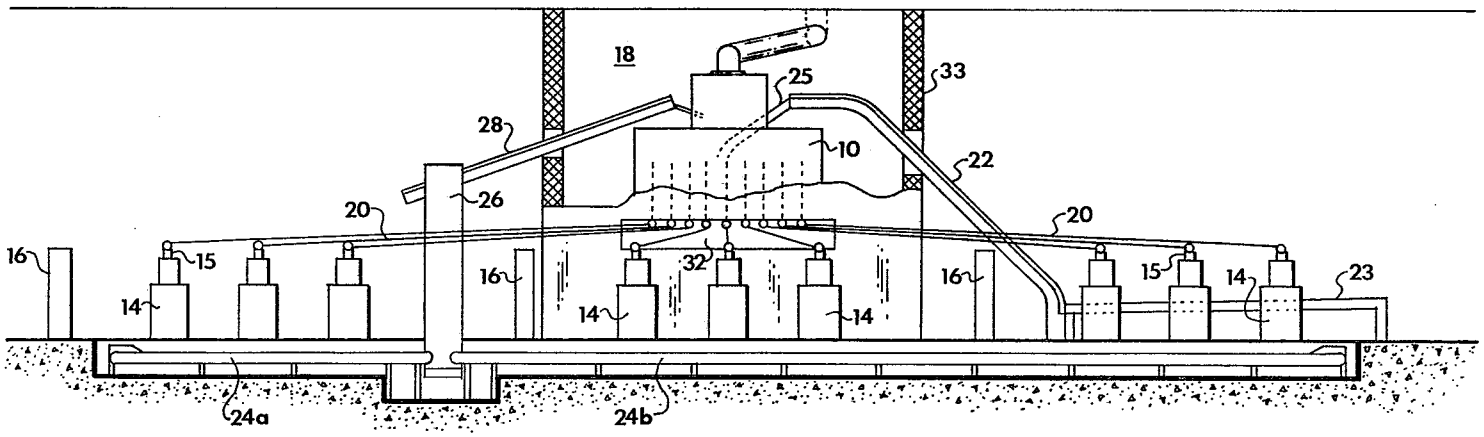
FIG. 2 is a schematic elevation view of the system according to the present invention.
Figure 3:
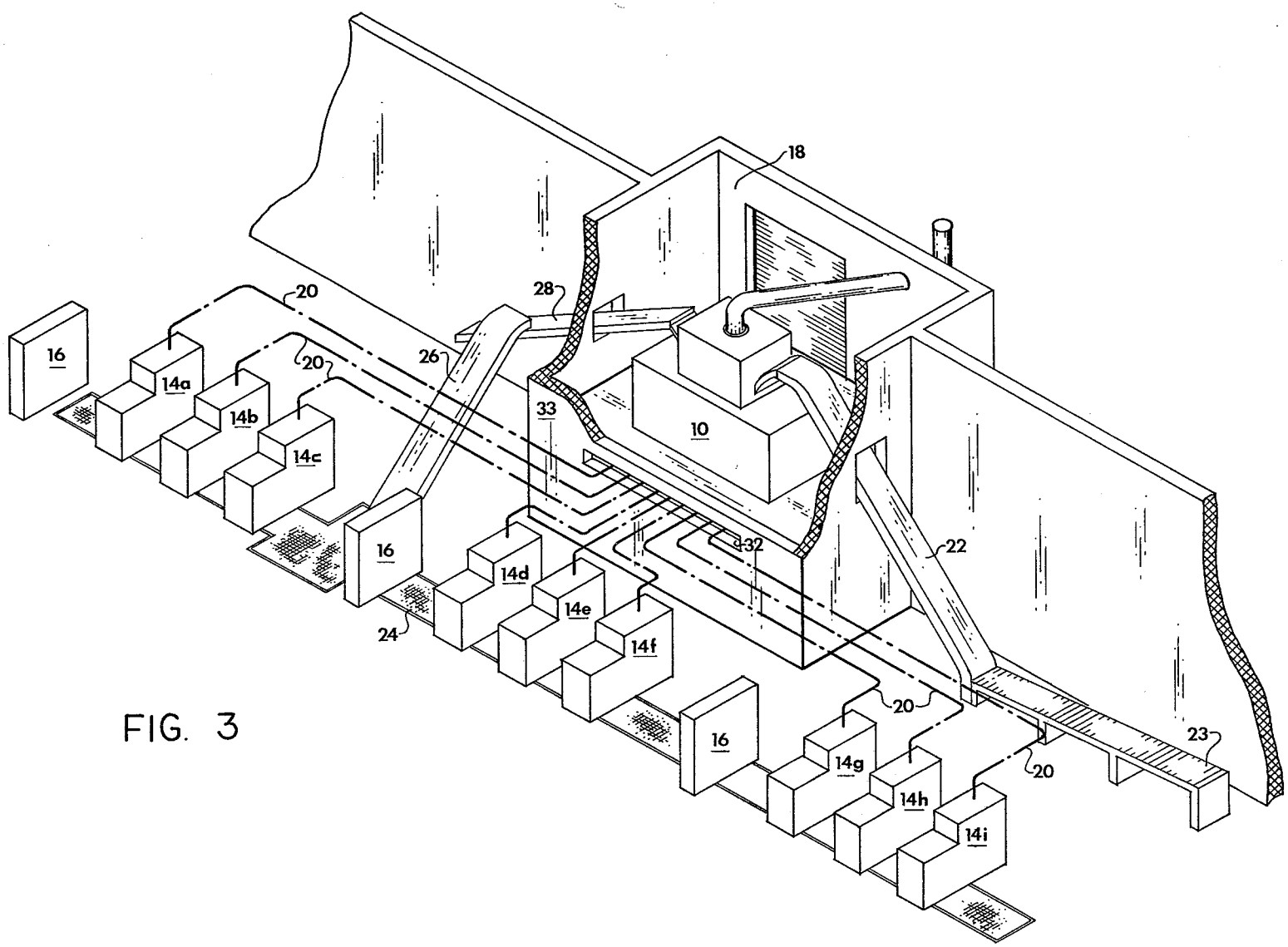
FIG. 3 is a perspective view illustrating the furnace/-casting system according to the present invention with the exhaust ducts removed.
Figure 4:
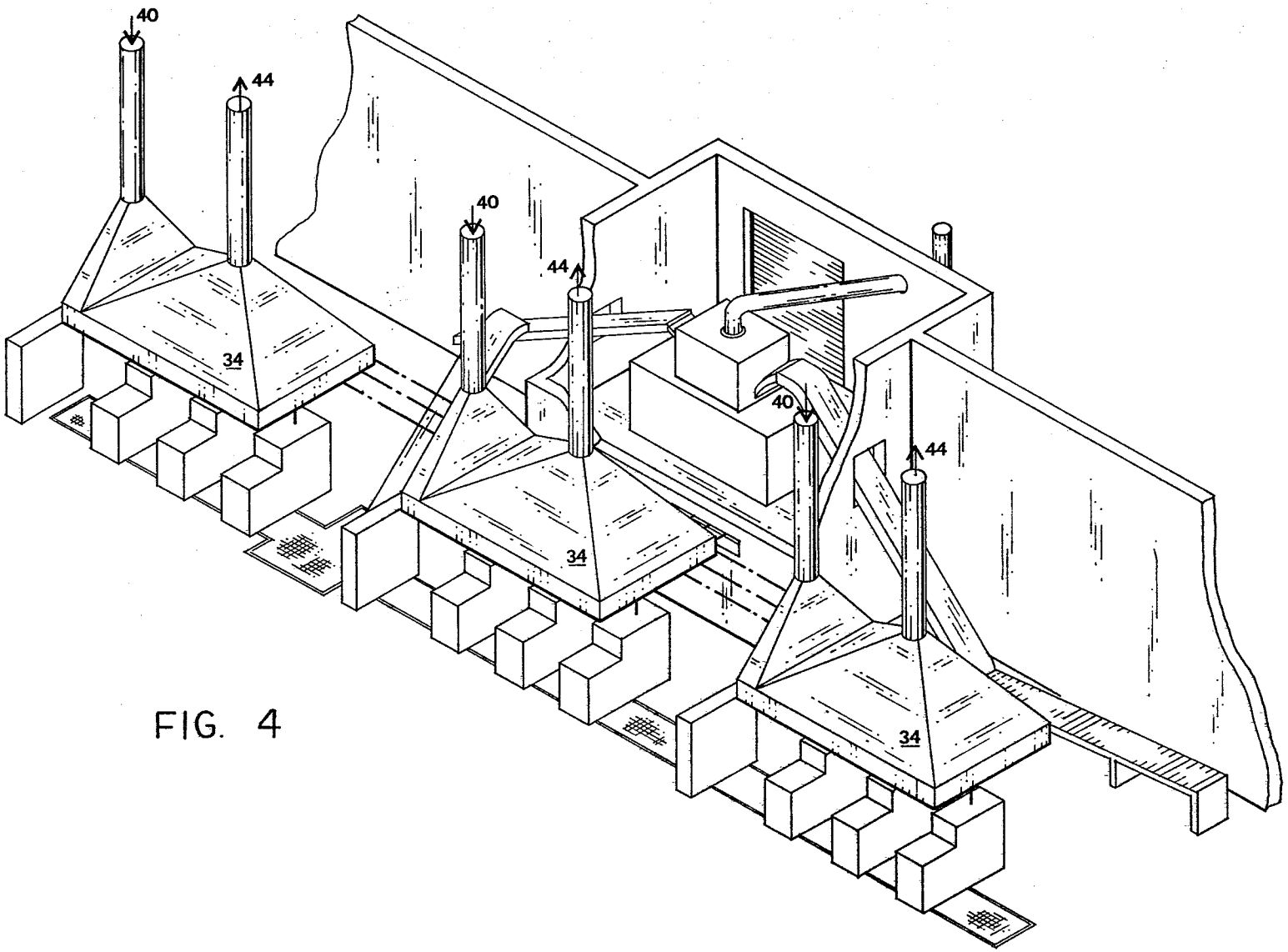
FIG. 4 is a perspective view, similar to FIG. 3, except with the exhaust ducts installed.
Figure 5:
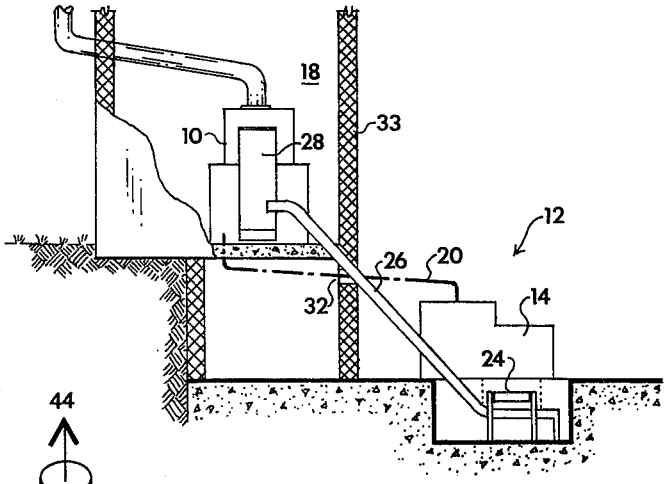
FIG. 5 is a sectional view taken substantially along lines 5—5 in FIG. 1.

An inclined raw metal or pig conveyor 22 receives the incoming pigs on a gravity conveyor 23 at floor level of the casting area and delivers the raw pigs through an opening in the side wall of the furnace room 18. As illustrated in FIG. 2, the pigs are now allowed to drop freely into the molten lead of the furnace, but rather are delivered at a controlled speed rate down a covered slide 25 into the furnace. This prevents or minimizes the splash which leads to increased drossing. Also, a metal chip conveyor 24 extends beneath the casting room floor connecting each casting machine 14*a*-14*i* and delivers the metal trim collected thereon from each of these machines onto a set of inclined conveyors 26,28. The trimmings are lifted by conveyors 26,28 through the side wall of furnace room 18 and side wall of furnace 10 to a point vertically spaced from the molten lead, from whence they are dropped freely into the furnace. The end point of conveyor 28 is so spaced from the surface of the molten lead that the lighter trim will penetrate the surface scum when dropped. So arranged, the furnace receives raw pigs and metal trim automatically from conveyors 24 and 28. In doing so, the top of the furnace does not have to be left open, and pigs and metal are not dropped manually thereinto. Therefore, any possibility of splash is prevented.

As best illustrated in FIGS. 1, 2, 3 and 5 the elevated furnace 10 is positioned with its bottom discharges 21 above the level of the input to the casting machines 14. This means that the floor of the furnace must be at least seven feet above the floor level of the casting area, whereupon the molten metal is delivered to the feed line system 20 by gravity, and pumping and other agitating within the furnace 10 is eliminated. The furnace room and supporting structure must be so constructed so as to support a 30,000 pound plus load at a seven foot level above the floor. The furnace itself is preferably a fifteen ton capacity electric furnace with associated heating means, so designed as to maintain the molten metal at a temperature of 700°-800° F. assuming an incoming feed rate of one hundred pounds per minute. The furnace 10 is covered to make the atmosphere within the furnace as oxygen free as possible, thereby reducing substantially the aforementioned drossing problems. It is believed that one of such furnaces can service up to eighteen casting machines, although the drawings only illustrate nine.

Figure 7:
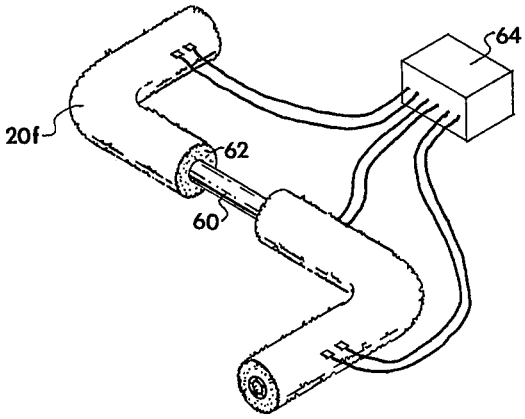
FIG. 7 is a perspective view, with parts broken away, illustrating the feed lines according to the present invention.

Extending toward the casting machines 14 from the bottom outlets 21 of furnace 10 is a feed line means 20 which includes a plurality of impedance heated feed lines or conduits capable of generating sufficient heat to elevate the temperature of the molten lead entering the feed line system at 700° F. to a temperature of 850° F. or above by the time it reaches the casting machines at a flow rate of ten pounds per minute. Preferably, such conduits are in the form of 1½ inch alloy pipe which are heated to temperature by the application of high current, low voltage from a plurality of variable transformers sold commercially as Varitrans, and capable of providing at least 10 kva. The walls of conduit 60 (FIG. 7) are of such material as to withstand at least 1200° F. without melting or deforming. Each conduit is surrounded by approximately three inches of insulation 62 and connected to one of the Varitrans 64 at spaced points therealong which supply the necessary current to achieve the heating of the molten metal to 850° F. and above. Feed lines 20*a*–20*i*, as previously mentioned, receive the molten metal through the outlet openings 21 in the bottom of furnace 10 and extend through a slot 32 in the wall 33 which separates the furnace room 18 from the casting area 12. Feed lines 20 distribute molten lead alloy throughout the casting room at a level above the casting machines 14, and into the inlet 15*a*–15*i* of each casting machine 14.

Figure 6:
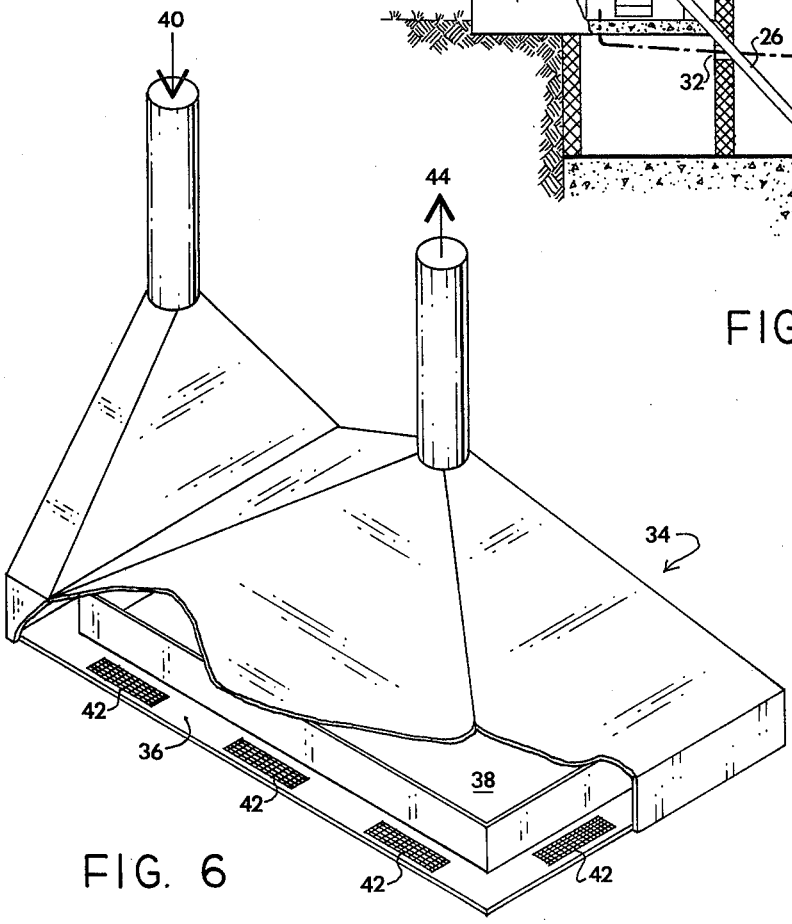
FIG. 6 is a perspective view of the exhaust system according to the present invention.

The casting machines 14 are of a standard design which forms no part of the present invention. In accordance with the present invention, however, a trim conveyor 24*a*,24*b* extends beneath floor level between all casting machines where the trim is deposited and automatically carried back into the furnace 10 by conveyors 26,28. An exhaust hood 34 serves each group of these machines and is positioned above the machines to collect exhaust fumes generated by the casting machines 14. As illustrated in FIG. 6, the exhaust hood includes an outer plenum 36 and an inner duct 38. The outer plenum 36 is provided with make-up air from a source of positive air pressure 40 and distributes such make-up air through diffusers 42. The inner duct 38 is connected to a source of negative air pressure 44. So arranged, the make-up air is delivered through peripheral diffusers 42 in the general direction of the casting machines, while the contaminated exhaust is picked up centrally and delivered to the atmosphere through whatever cleanup equipment is provided. Diffusers 42 are so regulated that the make-up air is not directed at the molds themselves. Drafts directed at the molds can create casting problems. Preferably, the exhaust or negative pressure is of such magnitude as to remove 2000 cfm of air while the make-up air is delivered at the rate of approximately 1500 cfm, so that the conditioned air around the casting machines is not materially affected. Thus the air in the casting room can be more easily controlled. Further, the casting room 12 is slightly pressurized to make sure that the air exhausted from the casting machines is sent up through the central duct 38 and not allowed to disseminate into the casting room.

In operation, the raw lead, generally in the form of pigs, is delivered on gravity conveyor 23 to the inclined delivery conveyor 22 from whence it is delivered at a controlled rate down a chute 25 into the electric furnace 10. Within the furnace 10, the pigs are melted to a lower than casting temperature (700°-800° F.) in a substantially oxygen free atmosphere to minimize the drossing tendency. Further, there is no agitation therein caused by pumping of the molten lead therefrom, as the lead is delivered from the furnace by means of bottom discharges forming a gravity feed system. The molten lead at a temperature of 700°-800° F. leaves the furnace 10 and is delivered by means of the impedance heated feed conduits 20 to the individual casting machines. Within the feed lines 20, the molten lead is increased in temperature to approximately 900° F. or the desired casting temperature, which temperature can be easily and precisely maintained.

Upon completion of the casting, the excess gate metal and flash is trimmed away from the finished grids and deposited on the return metal trimming conveyors 24 from whence it is delivered back into the furnace 10 by means of inclined conveyors 26,28. Therefore the trimmings are not allowed to be contaminated with impurities. Therefore only clean trim can return into furnace 10. The extreme temperatures generated by the furnace are thus kept isolated from the casting room, and it therefore becomes an enjoyable atmosphere in which to work. Since the excessive temperatures and the lead dust in the casting area have been substantially eliminated, the air and atmosphere within the casting room can now be more easily conditioned for the comfort and health of the workers therein.

The above-described installation, while preferable as a complete combination, includes various features which alone are unique approaches without all the other improvements. Therefore, while a preferred embodiment of the present invention has been described hereinabove, it is apparent that various alterations, modifications, combinations and subcombinations may be made without departing from the scope of the invention which is set forth in the claims below.

We claim:

1. An installation for the casting of battery grids:

(a) a plurality of casting machines positioned in a first plant area having a first atmosphere therein;

(b) a melting furnace positioned in a second plant area having a second atmosphere therearound, said second plant area substantially isolated from said first plant area by a wall means, said furnace being positioned on a level above the intake of said casting machines;

(c) a feed line means connecting said furnace with said casting machines and extending through an opening in said wall;

(d) whereby the atmosphere of said first area is kept substantially separate from and substantially unaffected by the operation of said furnace.

2. The installation according to claim 1 wherein said furnace is provided with a cover.

3. The installation according to claim 1 wherein said furnace includes a bottom discharge means for delivery of molten metal therefrom into said feed line means.

4. The installation according to claim 1 wherein said furnace is heated by electricity and includes heating means of such a capacity as to maintain on the molten metal in the furnace a temperature of 700°-800° F., whereby one furnace can supply sufficient molten lead to service six to 18 casting machines and the output from said furnace includes molten metal at a temperature lower than the casting temperature.

5. The installation according to claim 1 wherein said furnace includes two separate conveyor feed means, the first of said conveyor feed means extending through the furnace wall and comprising a covered slide from a point above the level of the molten metal therein toward the molten metal for introducing pigs of raw lead at a controlled rate to minimize splash, and said second conveyor feed means extending through the furnace wall and including a discharge point spaced considerably above the level of said molten metal for providing a vertical drop of scrap and trim into said molten metal, the distance of said discharge point above said molten metal being such as to cause pieces of trim and scrap metal, substantially less in weight than said pigs, to penetrate any dross layer which might be built up thereon.

6. The installation according to claim 5 wherein a collection conveyor extends beneath the floor and connects said casting machines, said collection conveyor terminating at the entrance to said conveyor feed means for collecting trim from each of said casting machines and delivering said trim back to said furnace.

7. The installation according to claim 1 wherein said feed line means includes a plurality of impedance heated conduits extending between said furnace and each of said casting machines, said conduits being of such capacity as to raise the temperature of molten metal received from the furnace at a temperature of 700°-800° F. to a temperature of at least 850° F. prior to the time the molten metal reaches the casting machines at a flow rate of ten pounds per minute.

8. The installation according to claim 1 wherein said casting machines are arranged in groups, an exhaust hood overlying each of said casting machine groups and comprising a central air duct through which exhaust gases are drawn and a peripheral air plenum separate from said central air duct through which air is delivered to the work area, a source of negative pressure associated with said central air duct and a source of positive pressure connected to said peripheral air plenum, said source of negative pressure being greater than said source of positive pressure, so that more air is exhausted from the area above said casting machines than is provided in the form of make-up air.

9. Process for preparing lead for and casting battery grids comprising the steps of:

(a) delivering raw lead to a melt furnace which is separate from and isolated from a casting area;

(b) heating the raw lead in said furnace without agitation to a temperature above the melting point but below the casting temperature;

(c) delivering the resulting molten lead by a gravity feed from the furnace into at least one heated feed line;

(d) heating said molten lead in said feed line during transportation therethrough to the casting temperature in the range of 850°-1000° F. while feeding to at least one casting machine; and (e) casting said molten lead into battery grids.

10. The process according to claim 9 wherein after the step of casting, the following steps occur:

(a) trimming the excess metal from the grid;

(b) collecting the trim metal on a continuous conveyor;

(c) delivering said metal trim back to said furnace and automatically feeding said trim thereinto.

* * * * *